United States Patent [19]

Borchert et al.

[11] 4,021,377

[45] May 3, 1977

[54] LIQUID DETERGENT COMPOSITION

[75] Inventors: Peter Jochen Borchert, Elkhart; Jerry Lee Neff, Nappanee, both of Ind.

[73] Assignee: Miles Laboratories, Inc., Elkhart, Ind.

[22] Filed: Sept. 11, 1973

[21] Appl. No.: 396,184

[52] U.S. Cl. ..... 252/546; 252/554; 252/559; 252/DIG. 12; 252/DIG. 14; 252/DIG. 1

[51] Int. Cl.[2] ..... C11D 1/12; C11D 9/30

[58] Field of Search ..... 252/546, 548, 153, 559, 252/DIG. 12, 554

[56] References Cited

UNITED STATES PATENTS

| | | | |
|---|---|---|---|
| 2,264,103 | 11/1941 | Tucker | 210/23 |
| 2,693,490 | 11/1954 | Eilar | 252/546 X |
| 3,095,379 | 6/1963 | Schwartz | 252/546 X |
| 3,549,544 | 12/1970 | Johnson | 252/548 |
| 3,563,902 | 2/1971 | Schmadel et al. | 252/554 X |
| 3,697,451 | 10/1972 | Mausner et al. | 252/548 X |
| 3,898,186 | 8/1975 | Mermelstein et al. | 252/545 |
| 3,898,187 | 8/1975 | Miller | 252/DIG. 14 |

OTHER PUBLICATIONS

McCutcheon's *Detergents and Emulsifiers* 1970 *Annual*. Allured Publishing Co. 1970.

*Primary Examiner*—Mayer Weinblatt
*Assistant Examiner*—Charles R. Wolfe, Jr.
*Attorney, Agent, or Firm*—R. W. Winchell

[57] ABSTRACT

A phosphate-free liquid detergent composition having useful soil-removing characteristics can be prepared from a mixture of at least one liquid anionic or nonionic surfactant material, water or water-glycol mixtures, and a reaction product of citric acid and a water soluble or water dispersible amine. In a preferred embodiment the liquid detergent composition also contains enzymes.

6 Claims, No Drawings

LIQUID DETERGENT COMPOSITION

BACKGROUND AND PRIOR ART

The soil-removing characteristics of detergent compositions are known to be improved, especially when the detergents are used in hard-water areas, by the addition of phosphate salts. These phosphate salts are known as "builders". With the increase in governmental action against the use of detergents containing phosphates, there is considerable interest in producing a phosphate-free detergent which still has the desired soil-removing characteristics. Citrates, such as citric acid and sodium citrate, have been suggested in the prior art as possible builder replacements for phosphates. Such citrates have not been suitable for use in liquid detergent compositions, because they are not compatible with the surfactants and form separate phases or layers in the liquid mixture. Prior liquid detergent compositions containing enzymes have also not been satisfactory in that the enzyme activity is not stable during storage. There is thus a need for a phosphate-free liquid detergent composition and also a need for such composition that can maintain stable enzyme activity.

SUMMARY OF THE INVENTION

In accordance with the present invention a satisfactory phosphate-free liquid detergent composition of matter is provided which comprises a mixture of at least one liquid anionic or nonionic surfactant material, a reaction product of citric acid and a water soluble or water dispersible amine, and a solvent selected from water and water-glycol mixtures.

DESCRIPTION OF THE INVENTION

The various ingredients of the novel detergent composition of the present invention are readily available from commercial sources. One suitable liquid anionic or nonionic surfactant is sodium linear alkylate sulfonate available from the Arco Chemical Co. in an anhydrous form under the designation "Ultrawet K" or in an aqueous solution containing 42 weight percent dissolved solids under the designation "Ultrawet 42K". "Ultrawet" is a trademark for a series of biodegradable linear alkylate sulfonate anionic detergents or surface-active agents (The Condensed Chemical Dictionary, 8th Edition, page 910, Copyright 1971). The term "linear alkylate sulfonate" is defined as a straight-chain alkylbenzene sulfonate; a detergent specially tailored for biodegradability, wherein the linear alkylates may be normal or iso (branched at the end only) but are $C_{10}$ or longer (Id. at pages 28 to 29). Another suitable liquid surfactant is dimethylamine sulfonate available from the Pilot Chemical Co. under the designation "Calimulse DMS". The trademarked product, "Calimulse DMS", is a dimethylamine salt made from cold sulfonated linear alkylate sulfonic acid (Pilot Chemical Co. Product Bulletin No. 520–7297–2). A further suitable surfactant is sodium xylene sulfonate available from the Pilot Chemical Co. under the designation "SXS 96". Still further suitable surfactants are the coconut fatty acid diethanolamide available from Finetex Inc. under the designation "Aminol HCA" and the coconut fatty acid monoethanolamide available from Henkel International Inc. under the designation "Standamid - CM". These materials are used in an amount from about 15 to about 20 weight of the detergent composition.

The citric acid-amine reaction product is obtained by mixing citric acid and a water soluble or water dispersible amine in water or a glycol until all the citric acid is dissolved. The heat of reaction will generally cause the mixture temperature to rise to about 40° C. in about one hour. If desired, the mixture can be heated to about 100°–110° C. and the reaction can be completed in about 5 to 10 minutes. The resulting salt has a high viscosity. The reaction product is a mixture of amine salts of citric acid and citric acid amides. The two possible reaction mechanisms are shown in the following equations. The first equation shows the formation of an amine salt between citric acid and monoethanolamine (mole ratio 1:1), and the second equation shows the formation of an amide between the same compounds and with the same molar ratio:

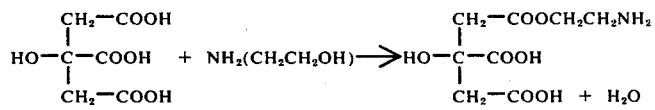

(1)

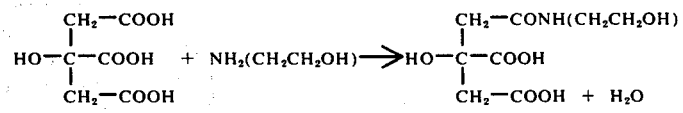

(2)

Since there are three reactive positions on the citric acid molecule, the amine can be employed in amounts of one, two or three moles per mole of citric acid.

Suitable water soluble or water dispersible amines for use in the present invention are aliphatic amines, such as monoethanolamine, diethanolamine, triethanolamine, ethyl amine, diethyl amine, tripropyl amine, ethylene diamine, diethylene triamine, polyethylene amine; fatty acid amines, such as lauryl amine; and heterocyclic amines, such as morpholine.

The reaction product is used in an amount from about 30 to about 65 weight percent based on the total weight of the detergent composition.

The surfactant and citric acid-amine reaction product are mixed with a solvent consisting of water or mixtures of water and glycol. Suitable glycols are ethylene glycol, diethylene glycol, propylene glycol, glycerin and the like. The total solvent should be from about 15 to about 50 weight percent of the total detergent composition. The water is present in amounts from about 6 to about 26 weight percent and the glycol is present in amounts from about 3 to about 36 weight percent.

It is desirable that the liquid detergent composition also contain enzymes, such as protease and amylase, to assist in removing stains from clothing. It has been found that when the water content of an enzyme-containing mixture exceeds about 10 weight percent, the enzyme activity is destroyed upon prolonged storage. Suitable enzymes employed in the present invention are proteases and amylases obtained from Bacillus subtilis, but other enzymes known in the detergent enzyme art can also be employed. Such enzymes are included in an amount of about 0.5 weight percent of the total composition.

The compositions of the present invention can also contain well-known brightening agents, bactericides and anti-redeposition agents if desired.

In addition to providing desired cleaning characteristics, the detergent composition of the present invention can effectively remove soil over a broad pH range from about 4 to about 12.

The soil-removal characteristics of these detergent compositions were determined in the following manner. Each composition was dissolved in water at a level of 0.25 weight percent. The water had a hardness of about 100–150 ppm calcium and magnesium salts. A standard soiled cloth sample (8 × 2.5 in.) was placed into 1000 ml of the aqueous detergent composition at 120° F. and was agitated at 125 cycles per min. for 10 min. The cloth sample was then removed from the solution, drained, squeezed by hand and then placed in 1000 ml. clean water (100–150 ppm hardness) at 120° F. and agitated for 5 min. as a rinse cycle. The cloth sample was then removed, drained, squeezed by hand and dried between blotting paper on an electric hot plate for about 5 min. The average light reflectance of the dried cloth was determined by taking three reflectometer readings. Reflectance readings were taken both on the soiled areas and the unsoiled areas (redeposition study) of the cloth samples both before and after washing. The percent soil removal was calculated by the following equation:

$$\% \text{ Soil removal} = \frac{A - B}{C - B} \times 100$$

wherein

A = reflectance of soiled portion after washing,

B = reflectance of soiled portion before washing,

C = reflectance of redeposition portion before washing.

The invention will be described in further detail in the following examples.

EXAMPLES 1 – 7

Various mixtures of ingredients were employed to produce liquid detergent compositions which had no phase separation. These compositions were then tested for their soil removal abilities. The results are shown in the following table wherein the ingredients are listed in weight percent:

TABLE 1

| Example No. | 1 | 2 | 3 | 4 | 5 | 6 | 7 |
|---|---|---|---|---|---|---|---|
| Anhydrous citric acid | 19.2 | 19.2 | 19.2 | 19.2 | 19.2 | 19.2 | 19.2 |
| Triethanolamine | 14.9 | 29.8 | 44.4 | — | — | — | — |
| Diethanolamine | — | — | — | 21.0 | 31.6 | — | — |
| Monoethanolamine | — | — | — | — | — | 12.2 | 18.3 |
| Ultrawet 42K | 28.4 | 28.4 | 28.4 | 28.4 | 28.4 | — | — |
| Ultrawet K | — | — | — | — | — | 12.0 | 12.0 |
| Calimulse DMS | — | — | — | — | — | — | — |
| SXS 96 40% | 15.0 | 15.0 | — | 15.0 | 15.0 | — | — |
| Anhydrous | — | — | 6.0 | — | — | 6.0 | 6.0 |
| Aminol HCA | 2.0 | 2.0 | 2.0 | 2.0 | 2.0 | 2.0 | 2.0 |
| Water | — | — | — | — | — | 25.6 | 25.6 |
| Diethylene glycol | 20.3 | 5.6 | — | 14.4 | 3.8 | 23.0 | 16.9 |
| Mole ratio citric acid:amine | 1:1 | 1:2 | 1:3 | 1:2 | 1:3 | 1:2 | 1:3 |
| Water plus glycol | 45.8 | 31.1 | 16.5 | 39.9 | 29.3 | 48.6 | 42.5 |
| Weight percent dissolved solis | 54.2 | 68.9 | 83.5 | 60.1 | 70.7 | 51.4 | 57.5 |
| pH | 4.3 | 6.5 | 8.2 | 6.4 | 9.0 | 5.5 | 8.7 |
| Percent Soil Removal | | | | | | | |
| Cotton | 17.0 | 17.9 | 23.6 | 16.6 | 23.1 | 21.4 | 19.1 |
| Dacron 35/Cotton | 26.2 | 21.9 | 16.7 | 23.9 | 19.4 | 15.8 | 19.3 |

EXAMPLE 8

This example describes the production and use of the preferred detergent composition. To 35 weight parts of diethylene glycol were added 24 weight parts of diethanolamine and 15 weight parts of anhydrous citric acid. The mixture was stirred for one hour. To the resulting solution were then added 14 weight parts of Calimulse DMS, 10 weight parts of Ultrawet 42K (4 weight parts surfactant and 6 weight parts water) and 2 weight parts of Standamid - CM. To the resulting mixture were then added 0.5 weight parts of an optical whitener marketed by American Cyanamid under the tradename Calcofluor White M2R New.

Another batch of the same formulation was prepared which contained in addition 0.5 weight parts of an enzyme mixture of protease and amylase produced by Bacillus subtilis. The enzyme mixture contained a minimum of 2,000,000 amylase units per gram and about 320,000–375,000 protease units per gram. This total composition thus contained about 20 weight percent surfactants, about 39 weight percent of a citric acid-amine reaction product, about 6 weight percent water, about 35 weight percent glycol and about 0.5 weight percent enzymes.

Both formulations were then used to clean three different test cloths. BMI (blood, milk and ink stains), cotton soil test cloth, and Dacron 35/Cotton 65 soil test cloth. The results are shown in the following table:

TABLE 2

| Cloth | Percent Soil Removal | |
|---|---|---|
| | Without Enzyme | With Enzyme |
| BMI | 11.9 | 22.0 |

TABLE 2-continued

| Cloth | Percent Soil Removal Without Enzyme | With Enzyme |
|---|---|---|
| Cotton | 21.5 | 21.8 |
| Dacron/Cotton | 24.7 | 24.3 |

This example clearly shows the effectiveness of the formulation without enzymes to clean cotton and Dacron/Cotton mixtures and the effectiveness of the formulation with enzymes to additionally remove blood, milk and ink stains.

EXAMPLE 9

This example describes the enzyme storage stability of the compositions of the present invention. A portion of the enzyme-containing formulation of Example 8 was used to clean a BMI test cloth. There was a 21.5 percent soil removal. The formulation was then allowed to stand at 72° F. for 4 months. It was then used to clean a new sample of BMI test cloth. There was a 27.2 percent soil removal. The storage was thus not detrimental to the enzyme activity.

What is claimed is:

1. A liquid, enzyme stable, phosphate free, detergent composition of matter consisting essentially of:

a. about 15 to 20 percent only of a liquid anionic or nonionic material selected from the class consisting of sodium linear alkylate sulfonate, dimethylamine sulfonate, sodium xylene sulfonate, coconut fatty acid diethanolamide, coconut fatty acid monothanolamide and mixtures thereof;

b. about 30 to 65 percent of a reaction product of citric acid and a water soluble or water dispersible amine selected from the class consisting of monoethanolamine, diethanolamine and triethanolamine with a citric acid/amine mole ratio of 1:1 to 1:3 obtained by reacting the citric acid with the amine at a temperature from about 40 to 110° C for a time from about 5 to 60 minutes or until the citric acid is dissolved;

c. about 15 to 50 percent of a solvent selected from the class consisting of water and water-glycol mixtures wherein said glycol is selected from the class consisting of ethylene glycol, diethylene glycol, propylene glycol and glycerin; and d. about 0.5 percent of fan enzyme selected from the class consisting of protease, amylase and mixtures thereof, said percentages being by weight based on the total weight of the composition.

2. A method of providing a liquid, enzyme stable, phosphate free, detergent composition of matter, which comprises the step of combining about 0.5 percent of an enzyme selected from the class consisting of protease, amylase and mixtures thereof with the ingredients consisting essentially of:

a. about 15 to 20 percent only of a liquid anionic or nonionic material selected from the class consisting of sodium linear alkylate sulfonate, dimethylamine sulfonate, sodium xylene sulfonate, coconut fatty acid diethanolamide, coconut fatty acid monoethanolamide and mixtures thereof;

b. about 30 to 65 percent of a reaction product of citric acid and a water soluble or water dispersible amine selected from the class consisting of aliphatic, fatty acid and heterocyclic amines with a citric acid/amine mole ratio of 1:1 to 1:3 obtained by reacting the citric acid with the amine at a temperature from about 40° to 110° C for a time from about 5 to 60 minutes or until the citric acid is dissolved; and c. about 15 to 50 percent of a solvent selected from the class consisting of water and water-glycol mixtures, wherein said glycol is selected from the class consisting of ethylene glycol, diethylene glycol, propylene glycol and glycerin, said percents being by weight based on the total weight of the composition.

3. A method according to claim 2 wherein the solvent contains water in an amount from about 6 to about 26 percent.

4. A method according to claim 2 wherein the solvent contains a glycol in an amount from about 3 to about 36 percent.

5. A method according to claim 2 wherein the ingredients consist essentially of about 20 percent anionic or nonionic material, about 39 percent of a citric acid-amine reaction product, about 6 percent water, and about 35 percent glycol.

6. A method according to claim 2 wherein the water soluble or water dispersible amine is selected from the class consisting of monoethanolamine, diethanolamine, triethanolamine, ethyl amine, diethyl amine, tripropyl amine, ethylene diamine, diethylene triamine, polyethylene amine, lauryl amine and morpholine.

* * * * *

UNITED STATES PATENT OFFICE

CERTIFICATE OF CORRECTION

PATENT NO. : 4,021,377

DATED : May 3, 1977

INVENTOR(S) : Peter J. Borchert & Jerry L. Neff

It is certified that error appears in the above-identified patent and that said Letters Patent are hereby corrected as shown below:

Column 2, Line 14, After "weight" insert -- percent --.

Column 2, Line 14, After "the" insert -- total weight of the --

Signed and Sealed this

*Twenty-seventh* Day of *September 197*

[SEAL]

*Attest:*

RUTH C. MASON
*Attesting Officer*

LUTRELLE F. PARKER
*Acting Commissioner of Patents and Trademark*